US005744433A

United States Patent [19]

Storström et al.

[11] Patent Number: 5,744,433

[45] Date of Patent: Apr. 28, 1998

[54] METAL POWDER COMPOSITION FOR WARM COMPACTION AND METHOD FOR PRODUCING SINTERED PRODUCTS

[75] Inventors: Helge Storström; Björn Johansson, both of Höganäs, Sweden

[73] Assignee: Höganäs AB, Höganäs, Sweden

[21] Appl. No.: 750,040

[22] PCT Filed: Jun. 1, 1995

[86] PCT No.: PCT/SE95/00636

§ 371 Date: Nov. 29, 1996

§ 102(e) Date: Nov. 29, 1996

[87] PCT Pub. No.: WO95/33589

PCT Pub. Date: Dec. 14, 1995

[30] Foreign Application Priority Data

Jun. 2, 1994 [SE] Sweden ..... 9401922

[51] Int. Cl.[6] ..... C10M 149/18

[52] U.S. Cl. ..... 508/454; 508/103; 508/551; 75/252; 75/231; 419/31; 419/38; 419/53; 419/54

[58] Field of Search ..... 508/103, 551, 508/454; 75/767, 231, 252; 419/38, 31, 53, 54

[56] References Cited

U.S. PATENT DOCUMENTS

| | | | |
|---|---|---|---|
| 3,647,694 | 3/1972 | Swanson | 508/285 |
| 5,154,881 | 10/1992 | Rutz et al. | 419/37 |
| 5,368,630 | 11/1994 | Luk | 75/252 |
| 5,429,792 | 7/1995 | Luk | 419/36 |
| 5,476,534 | 12/1995 | Ogura et al. | 75/252 |

*Primary Examiner*—Jacqueline V. Howard
*Assistant Examiner*—Cephia D. Toomer
*Attorney, Agent, or Firm*—Burns, Doane, Swecker & Mathis, L.L.P.

[57] ABSTRACT

A lubricant for metallurgical powder compositions contains an oligomer of amide type, which has a weight-average molecular weight $M_w$ of 30,000 at the most. A metal-powder composition containing the lubricant, as well as a method for making sintered products by using the lubricant, are also disclosed. Further, the use of the lubricant in warm compaction is described.

21 Claims, No Drawings

METAL POWDER COMPOSITION FOR WARM COMPACTION AND METHOD FOR PRODUCING SINTERED PRODUCTS

This application is a 371 of PCT/SE95/00636, filed Jun. 1, 1995.

FIELD OF THE INVENTION

This invention relates to a lubricant for metallurgical powder compositions, as well as a metal-powder composition containing the lubricant. The invention further concerns a method for making sintered products by using the lubricant, as well as the use of the lubricant in a metal-powder composition in warm compaction. Particularly, the invention concerns lubricants which, when warm-pressed, result in products having high unsintered strength (green strength).

BACKGROUND OF THE INVENTION

In industry, the use of metal products manufactured by compacting and sintering metal-powder compositions is becoming increasingly widespread. A number of different products of varying shapes and thicknesses are being produced, and the quality requirements placed on these products are continuously raised. Thus, it is of paramount importance that the manufactured metal products have high density as well as high strength.

In metal compaction, different standard temperature ranges are used. Thus, cold pressing is predominantly used for compacting metal powder (the powder has room temperature). Use is also made of hot isostatic pressing (HIP) and warm pressing (compaction at temperatures between those used in cold pressing and HIP). Both cold pressing and warm pressing require the use of a lubricant.

Compaction at temperatures above room temperature has evident advantages, yielding a product of higher density and higher strength than compaction performed at lower pressures.

Most of the lubricants used in cold compaction cannot be used in high-temperature compaction, since they seem to be effective within a limited temperature range only. An ineffective lubricant considerably increases the wear of the compacting tool.

How much the tool is worn is influenced by various factors, such as the hardness of the material of the tool, the pressure applied, and the friction between the compact and the wall of the tool when the compact is ejected. This last factor is strongly linked to the lubricant used.

The ejection force is the force required for ejecting the compact from the tool. Since a high ejection force not only increases the wear of the compacting tool but also may damage the compact, this force should preferably be reduced.

However, the use of a lubricant may create problems in compaction, and it is therefore important that the lubricant is well suited to the type of compaction carried out.

In order to perform satisfactorily, the lubricant should, in the compacting operation, be forced out of the pore structure of the powder composition, and into the gap between the compact and the tool, thereby lubricating the walls of the compacting tool. By such lubrification of the walls of the compacting tool, the ejection force is reduced.

Another reason why the lubricant has to emerge from the compact is that it would otherwise create pores in the compact after sintering. It is well-known that large pores have an adverse effect on the dynamic strength properties of the product.

BACKGROUND ART

U.S. Pat. No. 5,154,881 (Rutz) discloses a method for making sintered products on the basis of a metal-powder composition containing an amide lubricant. Apart from the lubricant, which consists of the reaction product of a monocarboxylic acid, a dicarboxylic acid and a diamine, the composition contains iron-based powder. The amide lubricant thus consists of an amide product mixture chiefly made up of diamides, monoamides, bisamides and polyamides (of column 4, lines 55–56). Especially preferred as a lubricant is ADVAWAX® 450 or PROMOLD® 450, which is an ethylenebisstearamide product.

Furthermore, U.S. Pat. No. 4,955,789 (Musella) describes warm compaction more in general. According to this patent, lubricants generally used for cold compaction, e.g. zinc stearate, can be used for warm compaction as well. In practice, however, it has proved impossible to use zinc stearate or ethylenebisstearamide (commercially available as ACRAWAX®), which at present are the lubricants most frequently used for cold compaction, for warm compaction. The problems which arise are due to difficulties in filling the die in a satisfactory manner.

Accordingly, an object of the the invention is to provide a lubricant enabling the manufacture of compacted products having high green strength and high green density, as well as sintered products having high sintered density and low ejecting force from the lubricant in combination with iron-based powders having high compressability. The improvements in green strength are especially important. High green strength can make the compact machinable and facilitates the handling of the compact between compaction and sintering, and it further results in a sintered product of high density and strength. This is especially important in the case of thin parts. Thus, the product must keep together during the handling between compaction and sintering without cracking or being otherwise damaged, the compact being subjected to considerable stresses when ejected from the compacting tool.

SUMMARY OF THE INVENTION

The lubricant according to the invention essentially consists of an oligomer of amide type, which has a weight-average molecular weight $M_W$ of 30,000 at the most and, preferably, at least 1,000. Most preferably $M_W$ varies between 2,000 and 20,000. In this context the expression "oligomer" is intended to include also lower polyamides i.e. polyamides having a molecular weight, $M_W$ of 30 000 at the most. It is important that the oligomer does not have too high a molecular weight, since the density of the product will then be too low to be of interest in industrial applications. In this context, the phrase "essentially consists of" means that at least 80% of the lubricant, preferably at least 85% and most preferably 90% by weight, is made up of the oligomer according to the invention.

The invention further concerns a metal-powder composition containing iron-based powder and the above-mentioned lubricant, as well as a method for making sintered products. The method according to the invention comprises the steps of a) mixing an iron-based powder and a lubricant to a metal-powder composition, b) preheating the metal-powder composition to a predetermined temperature, c) compacting the metal-powder composition in a tool, and d) sintering the compacted metal-powder composition at a temperature above 1050° C., use being made of a lubricant according to the invention.

The present invention further relates to the use of the lubricant according to the invention in a metallurgical powder composition in warm pressing.

DETAILED DESCRIPTION OF THE INVENTION

The lubricant according to the invention contains oligomers which include lactams containing the repeating unit $$—[NH—(CH_2)_m—CO]_n—$$

wherein m is in the range of 5–11, and n is in the range of 5–50.

Moreover, the oligomer may derive from diamines and dicarboxylic acids and contain the repeating unit $$—[NH—(CH_2)_m—NHCO(CH_2)_n—CO]_x—$$

wherein m and n are in the range of 4–12, m+n being greater than 12, and x is in the range of 2–25.

The oligomers containing the above-mentioned repeating units may have different terminal groups. Suitable terminal groups for the position of —[NH— . . . are, for instance, —H; —CO—R, wherein R is a straight or branched $C_2$–$C_{20}$ aliphatic or aromatic group, preferably lauric acid, 2-ethylhexanoic acid or benzoic acid; and —CO—$(CH_2)_n$—COOH, wherein n is 6–12. Suitable terminal groups for the position of . . . —CO]—, are for instance, —OH; —NH—R, wherein R is a straight or branched $C_2$–$C_{22}$ aliphatic group or aromatic group, preferably $C_6$–$C_{12}$ aliphatic group; and —NH—$(CH_2)_n$—$NH_2$, wherein n is 6–12.

Further, the oligomers in the lubricant according to the invention may have a melting point peak in the range of 120°–200° C. and have a porous or nonporous structure.

The lubricant can make up 0.1–1% by weight of the metal-powder composition according to the invention, preferably 0.2–0.8% by weight, based on the total amount of the metal-powder composition. The possibility of using the lubricant according to the present invention in low amounts is an especially advantageous feature of the invention, since it enables high densities to be achieved.

As used in the description and the appended claims, the expression "iron-based powder" encompasses powder essentially made up of pure iron; iron powder that has been prealloyed with other substances improving the strength, the hardening properties, the electromagnetic properties or other desirable properties of the end products; and particles of iron mixed with particles of such alloying elements (diffusion annealed mixture or purely mechanical mixture). Examples of alloying elements are copper, molybdenum, chromium, manganese, phosphorus, carbon in the form of graphite, and tungsten, which are used either separately or in combination, e.g. in the form of compounds ($Fe_3P$ and FeMo). Unexpectedly good results are obtained when the lubricants according to the invention are used in combination with iron-based powders having high compressability. Generally, such powders have a low carbon content, preferably below 0.04% by weight. Such powders include e.g. Distaloy AE, Astaloy Mo and ASC 100.29, all of which are commercially available from Höganäs AB, Sweden.

Apart from the iron-based powder and the lubricant according to the invention, the powder composition may contain one or more additives selected from the group consisting of binders, processing aids and hard phases. The binder may be added to the powder composition in accordance with the method described in U.S. Pat. No. 4,834,800 (which is hereby incorporated by reference).

The binder used in the metal-powder composition may consist of e.g. cellulose ester resins, hydroxyalkyl cellulose resins having 1–4 carbon atoms in the alkyl group, or thermoplastic phenolic resins.

The processing aids used in the metal-powder composition may consist of talc, forsterite, manganese sulphide, sulphur, molybdenum disulphide, boron nitride, tellurium, selenium, barium difluoride and calcium difluoride, which are used either separately or in combination.

The hard phases used in the metal-powder composition may consist of carbides of tungsten, vanadium, titanium, niobium, chromium, molybdenum, tantalum and zirconium, nitrides of aluminium, titanium, vanadium, molybdenum and chromium, $Al_2O_3$, $B_4C$, and various ceramic materials.

Apart from the lubricant according to the invention, the metal-powder composition may, if so desired, contain other lubricants, such as zinc stearate, lithium stearate and lubricants of amide wax type.

With the aid of conventional techniques, the iron-based powder and the lubricant particles are mixed to a substantially homogeneous powder composition.

Preferably, the lubricant according to the invention is added to the metal-powder composition in the form of solid particles. The average particle size of the lubricant may vary, but preferably is in the range of 3–100 μm.

If the particle size is too large, it becomes difficult for the lubricant to leave the pore structure of the metal-powder composition during compaction and the lubricant may then give rise to large pores after sintering, resulting in a compact showing impaired strength properties.

In warm pressing according to the invention, the metal-powder composition is advantageously preheated before being supplied to the heated compacting tool. In such preheating, it is of importance that the lubricant does not begin to soften or melt, which would make the powder composition difficult to handle when filling the compacting tool, resulting in a compact having a nonuniform density and poor reproducibility of part weights. Moreover, it is important that no partial premelting of the lubricant occurs, i.e. the lubricant is a uniform product.

The steps of the warm compaction process are the following:

a) mixing an iron powder, a high-temperature lubricant and optionally an organic binder;

b) heating the mixture, preferably to a temperature of at least 120° C.;

c) transferring the heat-powder composition to a die, which is preheated to a temperature of preferably at least 120° C.; and compacting the compostion at an elevated temperature of preferably at least 120° C.; and d) sintering the compact at a temperature of at least 1050° C.

In step b) of the method, the powder composition is preferably preheated to a temperature of 5°–50° C. below the melting point of the oligomer. Also, the tool is conveniently preheated to a temperature of 0°–30° C. above the temperature of the preheated metal-powder composition.

A few tests will now be accounted for in order to illustrate that the invention is effective and yields products of high green density as well as high green strength.

TEST 1

Table 1 below states a number of lubricants by indicating melting point peak, weight-average molecular weight $M_W$, measured green density (GD) and ejection force (Ej.F) in warm compaction of Distaloy AE (marketed by Höganäs AB), 0.6% by weight of lubricant and 0.3% by weight of graphite. The compaction pressure was 600 MPa, and the tool had a temperature of 150° C. The temperature of the incoming powders was 130° C.

TABLE 1

Lubricants according to the invention

| Lubricant | Mw g/mol | GD g/cm³ | Ej F kP/cm² | Particle-size µm | Melting point peak |
|---|---|---|---|---|---|
| Orgasol 3501 | 6500 | 7,34 | 170 | 10 | 140 |
| Orgasol 2001 | 18000 | 7,22 | 150 | 5 | 176 |
| Orgasol 2002[1)] | 40000 | 7,07 | — | 30 | ? |
| Fe 4908 | 4000 | 7,29 | 140 | | 167 |
| Promold ® [2)] | ? | 7,30 | | | 142 |
| EBS[3)] | 590 | — | — | — | 140 |
| Grilamid L16[4)] | 35000 | 6,99 | 306 | | |
| H 2913-L[4)] | 2000 | 7,32 | 139* | | 144 |

[1)]outside the scope of the invention
[2)]lubricant according to U.S. Pat. No. 5,154,891 (substantially ethylene bisstearamide = EBS)
[3)]etylene bisstearamide - impossible to get accetable repreduction in filling operations at elevated temperature
[4)]oligomer of the type polyamide 12
*uneven ejection curve Lubricant FE 4908 consists of oligomers of the type polyamid 12 having a nonporous structure, m being 12.

Orgasol®2001 UD NAT 1, Orgasol®3501 EXD NAT 1 as well as Orgasol®2002 are commercial products from Elf Atochem, France.

The green density was measured according to ISO 3927 1985, and the ejection force was measured according to Höganäs Method 404.

The melting point peaks for the lubricants are indicated as the peak values of the melting curve, which was measured with the aid of Differential Scanning Calorimetry (DSC) technique on a Model 912S DSC instrument from TA Instruments, New Castle, Del. 197201 USA.

As appears from Table 1, high green densities can be attained, while the ejection forces remain low, when using oligomers according to the invention as lubricants. Oligomers of high molecular weight, on the other hand, result in too low a green density. However, too low a molecular weight results in an uneven ejection force.

TEST 2

The following test was performed in order to establish whether the temperature of the powders had any effect on GD and Ej.F.

As composition including FE 4908 from Test 1 above was compacted in a tool that had been preheated to a temperature of 150° C. The temperature of the incoming powders varied. The results are indicated in Table 2 below.

TABLE 2

| Powder temperature °C. | Green density g/cm³ | Ejection force kP/cm² |
|---|---|---|
| 20 | 7.09 | 151.8 |
| 100 | 7.12 | 137.0 |
| 130 | 7.14 | 131.1 |
| 150 | 7.16 | 133.8 |

TABLE 2-continued

| Powder temperature °C. | Green density g/cm³ | Ejection force kP/cm² |
|---|---|---|
| 170 | 7.20 | 130.1 |
| 185 | 7.35 | 164.3 |

As appears from Table 2, the green density (GD) increases when the powder temperature approaches the melting point peak of the lubricant. The ejection force seemed to have a minimum value in the range of 5°–50° C. below the melting point peak of the lubricants. If a certain oligomer is to be used as lubricant with maximum effect, the compaction temperature has to be adapted to suit the melting characteristics of the oligomer.

TEST 3

This test was performed in order to compare green density and green strength of compacts resulting from the compaction of powder compositions containing, respectively, a lubricant according to the invention and a lubricant according to U.S. Pat. No. 5,154,881. Compaction was carried out at different temperatures.

The metal-powder compositions contained the following ingredients.

Composition 1 (invention)

Distaloy®AE, marketed by Höganäs AB 0.3% by weight of graphite 0.6% by weight of Orgasol®2001 UD NAT 1

Composition 2 (U.S. Pat. No. 5,154,881)

Distaloy®AE 0.3% by weight of graphite 0.6% by weight of Promold®450, marketed by Morton International, Cincinnati, Ohio.

Compaction was carried out in a Dorst press, which had a die temperature of 150° C. The results are indicated in Table 3 below.

TABLE 3

| Composition | Powder temperature °C. | Compaction pressure MPa | Green density g/cm³ | Green strength N/mm² |
|---|---|---|---|---|
| 1 | 20 | 600 | 7.22 | 27.4 |
| | 100 | " | 7.22 | 28.5 |
| | 130 | " | 7.22 | 29.0 |
| | 150 | " | 7.22 | 29.7 |
| | 170 | " | 7.24 | 31.4 |
| | 180 | " | 7.34 | 41.3 |
| | 180 | 800 | 7.43 | 58.5 |
| 2 | 20 | 600 | 7.15 | 20.0 |
| | 100 | " | 7.23 | 27.0 |
| | 120 | " | 7.25 | 27.2 |
| | 160 | " | (7.32)* | (29.5)* |

*uncertain values, due to problems when filling the tools.

As appears from Table 3, the two lubricants result in products of comparable properties when the powder temperature is in the range of 20°–120° C. At higher powder temperatures, the products compacted with the lubricant according to the invention begin to show remarkably high green densities and green strengths.

The products that had been compacted with Orgasol®2001 were then sintered in order to ensure that acceptable sintered properties would be obtained, which was the case.

TEST 4

Yet another test was performed in order to compare a metal-powder composition according to the invention and a prior-art metal-powder composition containing the lubricant Promold®450.

The metal-powder compositions contained the following ingredients.

Composition 1 (invention)

Distaloy®AE 0.3% by weight of graphite 0.6% by weight of Orgasol®3501 EXD NAT 1

Composition 2 (prior art)

as above but with Promold 450 replacing Orgasol as lubricant

Compaction was performed in a Dorst press, which had a die temperature of 150° C. The powders had a temperature of 115° C. The results are indicated in Table 4 below.

TABLE 4

| Composition | Compaction pressure MPa | Ej. F kP/cm² | GD g/cm³ | GS N/mm² | Sintered density g/cm³ | Dimensional change ΔL % | Flexural strength N/mm² |
|---|---|---|---|---|---|---|---|
| 1 | 593 | 230 | 7.34 | 77.6 | 7.29 | +0.085 | 1443 |
| 2 | 600 | 327 | 7.30 | 27.9 | 7.29 | −0.02 | 1488 |

As appears from Table 4, the product resulting from the compaction of the metal-powder composition according to the invention had a remarkably high green strength.

TEST 5

Yet another test was performed in order to establish whether the lubricant according to the invention had the same effect when using prealloyed iron powder and pure iron powder.

In a Lödige mixer, two different metal-powder compositions containing the following ingredients were mixed.

1. Astaloy®Mo, a prealloyed iron powder from Höganäs AB (containing 1.5% of Mo), 0.2% of graphite and 0.6% of Orgasol®3501 EXD NAT 1.

2. ASC 100.29, an atomised pure iron powder, 0.2% of graphite and 0.65% of Orgasol®3501.

The results are indicated in Table 5 below.

TABLE 5

| Test product | Powder temperature °C. | Tool temperature °C. | Compaction pressure MPa | Green density g/cm³ |
|---|---|---|---|---|
| 1 | 120 | 130 | 730 | 7.40 |
| 2 | 120 | 130 | 730 | 7.42 |

As is evident from Table 5, equally high green densities were obtained with prealloyed and pure iron powders.

Thus, the lubricant according to the invention yields fully acceptable products showing high green density and high green strength, as well as satisfactory properties after sintering.

TEST 6

As appears from the following experiments, the oligomers according to the invention can be used also for cold compaction, even if the results obtained are not as advantageous as those which can be obtained with conventional lubricants for cold compaction. Moreeover, the use of an orgasol for cold compaction has been suggested by Molera P in the publication Deformation Metallica/14/1989. The technical data indicates that Molera has used Orgasol 2002, which is a compound having a molecular weight of 40,000.The following lubricants were used:

Kenolube P11 (commercially used lubricant)

Zinc stearate (commercially used lubricant)

Orgasol 2001 EXT D NAT 1

Orgasol 2002 D NAT 1

Orgasol 3502 D NAT 1

Green properties

Composition: ASC 100.29+0.8% Lubricant (mixed for 2 min in a Lödige labor-mixer).

Speciments: Ø 25 mm; Height approx. 20 mm

| Material | A.D. g/cm³ | Flow S/50 g | Green density g/cm³ 600 MPa | Green density g/cm³ 800 MPa | Ejection Force Kp/cm² 600 MPa | Ejection Force Kp/cm² 800 MPa |
|---|---|---|---|---|---|---|
| Kenolube | 3.23 | 24.4 | 7.15 | 7.28 | 148 | 174 |
| Zinc stearate | 3.34 | 25.6 | 7.18 | 7.31 | 199 | 233 |
| 2001 | 2.89 | 26.1 | 7.02 | 7.19 | 294 | —* |
| 2002 | 2.79 | 25.9 | 6.94 | —* | —* | —* |
| 3502 | 2.88 | 24.8 | 6.95 | 7.12 | 285 | —* |

—*The test had to be stopped due to the high ejection force.

Comments

Compared with the materials containing Kenolube and Zinc-stearate, the materials admixed with different grades of orgasol give a considerably higher ejection force and lower compressibility. The orgasol materials also reduce the apparent density.

We claim:

1. A metal powder composition for warm compaction comprising an iron-based powder and a lubricant powder consisting essentially of an amide oligomer having a weight-average molecular weight $M_W$ between 1,000 and 30,000 and a melting point peak in the range of 120° to 200° C.

2. A metal powder composition according to claim 1, which additionally contains one or more additives selected from the group consisting of binders, processing aids, and hard phases.

3. A metal powder composition according to claim 1, wherein said amide oligomer has a molecular weight of 2,000 to 20,000 and is present in said composition in an amount of less than 1% by weight.

4. A metal powder composition according to claim 1, wherein said iron-based powder is compressible, and at least 80% by weight of said lubricant powder is made up of said amide oligomer.

5. A metal powder composition according to claim 2, wherein said iron-based powder is compressible, and at least 80% by weight of said lubricant powder is made up of said amide oligomer.

6. A metal powder composition according to claim 4, characterized in that said iron-based powder has a carbon content of at most 0.04% by weight.

7. A metal powder composition according to claim 5, characterized in that said iron-based powder has a carbon content of at most 0.04% by weight.

8. A metal powder composition according to claim 1, wherein the lubricant powder is provided in a concentration 0.2 to 0.8% by weight of the composition.

9. A metal powder composition according to claim 2, wherein the lubricant powder is provided in a concentration 0.2 to 0.8% by weight of the composition.

10. A metal powder composition according to claim 4, wherein the lubricant powder is provided in a concentration 0.2 to 0.8% by weight of the composition.

11. A metal powder composition according to claim 6, wherein the lubricant powder is provided in a concentration 0.2 to 0.8% by weight of the composition.

12. A method for producing sintered products comprising:

(a) mixing an iron-based powder with a lubricant powder consisting essentially of an amide oligomer which has a weight-average molecular weight $M_W$ between 1,000 and 30,000, and a melting point peak in the range of 120° to 200° C., (b) preheating the metal-powder composition, (c) compacting the metal-powder composition in a preheated tool, and (d) sintering the compacted metal-powder composition at a temperature above 1050° C. to form a sintered product.

13. A method according to claim 12, wherein said amide oligomer has a weight-average molecular weight $M_W$ in the range of 2,000 to 20,000.

14. A method according to claim 12, wherein said amide oligomer includes lactams containing the repeating unit:

$$—[NH—(CH_2)_m—CO]_n—,$$

wherein m is in the range of 5 to 11, and n is in the range of 5 to 50.

15. A method according to claim 13, wherein said amide oligomer includes lactams containing the repeating unit:

$$—[NH—(CH_2)_m—CO]_n—,$$

wherein m is in the range of 5 to 11, and n is in the range of 5 to 50.

16. A method according to claim 12, wherein said amide oligomer is derived from diamines and dicarboxylic acids and contains the repeating unit:

$$—[NH—(CH_2)_m—NHCO(CH_2)_n—CO]_x—,$$

wherein m and n are in the range of 4 to 12, m+n is greater than 12, and x is in the range of 2 to 25.

17. A method according to claim 13, wherein said amide oligomer is derived from diamines and dicarboxylic acids and contains the repeating unit:

$$—[NH—(CH_2)_m—NHCO(CH_2)_n—CO]_x—,$$

wherein m and n are in the range of 4 to 12, m+n is greater than 12, and x is in the range of 2 to 25.

18. A method according to claim 12, wherein said amide oligomer has in its —NH— position a terminal group selected from —H, —CO—R wherein R is a straight or branched $C_2$ to $C_{20}$ aliphatic or aromatic group, and —CO—$(CH_2)_n$—COOH wherein n is 6 to 12, and has in its —CO— position a terminal group selected from —OH, —NH—R wherein R is a straight or branched $C_2$ to $C_{22}$ aliphatic group or aromatic group, and —NH—$(CH_2)_n$—$NH_2$ wherein n is 6 to 12.

19. A method according to claim 13, wherein said amide oligomer has in its —NH— position a terminal group selected from —H, —CO—R wherein R is a straight or branched $C_2$ to $C_{20}$ aliphatic or aromatic group, and —CO—$(CH_2)_n$—COOH wherein n is 6 to 12, and has in its —CO— position a terminal group selected from —OH, —NH—R wherein R is a straight or branched $C_2$ to $C_{22}$ aliphatic group or aromatic group, and —NH—$(CH_2)_n$—$NH_2$ wherein n is 6 to 12.

20. A method according to claim 12, wherein said powder composition in step (b) is preheated to a temperature of 5° to 50° C. below the melting point of said amide oligomer.

21. A method according to claim 12, wherein said tool before step (c) is preheated to a temperature of 0° to 30° C. above the temperature of said preheated metal-powder composition.

* * * * *